US009844253B2

(12) United States Patent
Samain

(10) Patent No.: US 9,844,253 B2
(45) Date of Patent: Dec. 19, 2017

(54) COSMETIC APPLICATION ELEMENT

(71) Applicant: L'OREAL, Paris (FR)

(72) Inventor: Henri Samain, Bievres (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 14/367,017

(22) PCT Filed: Dec. 18, 2012

(86) PCT No.: PCT/IB2012/057429
§ 371 (c)(1),
(2) Date: Jun. 19, 2014

(87) PCT Pub. No.: WO2013/093775
PCT Pub. Date: Jun. 27, 2013

(65) Prior Publication Data

US 2014/0352714 A1 Dec. 4, 2014

Related U.S. Application Data

(60) Provisional application No. 61/604,921, filed on Feb. 29, 2012.

(30) Foreign Application Priority Data

Dec. 20, 2011 (FR) ..... 11 61997

(51) Int. Cl.
*A45D 19/18* (2006.01)
*A45D 19/02* (2006.01)
(Continued)

(52) U.S. Cl.
CPC ..... *A45D 19/02* (2013.01); *A45D 19/0008* (2013.01); *A45D 44/005* (2013.01);
(Continued)

(58) Field of Classification Search
CPC ..... A45D 19/0008; A45D 19/0016; A45D 19/0025; A45D 19/02; A45D 24/46;
(Continued)

(56) References Cited

U.S. PATENT DOCUMENTS 5,860,431 A * 1/1999 Abercrombie ..... A45D 19/0025 132/208
5,913,315 A * 6/1999 Todd ..... A45D 2/40 132/206
(Continued)

FOREIGN PATENT DOCUMENTS

EP 0 251 968 A2 1/1988
EP 1 557 110 A1 7/2005
(Continued)

OTHER PUBLICATIONS https://www.youtube.com/watch?v=MnW6PfVXVho, Highlight-Professional Stylist Tutorial Ombre Finish, YouTube, May 2, 2014.*
(Continued)

*Primary Examiner* — Rachel Steitz
(74) *Attorney, Agent, or Firm* — Jones Robb, PLLC

(57) ABSTRACT

The present invention relates to a cosmetic device comprising:

a support and a composition, carried by the support, for dyeing or bleaching the hair, said composition having a formulation that varies depending on the position on the support, so as to allow shaded dyeing or bleaching to be produced on the hair by transfer.

21 Claims, 10 Drawing Sheets

(51) Int. Cl.

| | |
|---|---|
| ***A45D 19/00*** | (2006.01) |
| ***A45D 44/00*** | (2006.01) |
| ***A61Q 5/10*** | (2006.01) |

(52) U.S. Cl.
CPC ..... *A61Q 5/10* (2013.01); *A45D 2019/0075* (2013.01); *A45D 2019/0091* (2013.01); *A45D 2019/025* (2013.01); *A45D 2200/058* (2013.01)

(58) Field of Classification Search
CPC ..... A45D 2007/001; A45D 2019/0066; A45D 2019/0075; A45D 2019/0091; A45D 2019/02; A45D 2019/025; A45D 44/005
See application file for complete search history.

(56) References Cited

U.S. PATENT DOCUMENTS

| | | | |
|---|---|---|---|
| 2004/0093659 | A1 | 5/2004 | VeDepo |
| 2005/0184091 | A1 | 8/2005 | Abergel |
| 2006/0108247 | A1 | 5/2006 | Liechty et al. |
| 2006/0134030 | A1 | 6/2006 | Molenda et al. |
| 2007/0215169 | A1 | 9/2007 | Daneshvar |
| 2009/0220442 | A1 | 9/2009 | Brillouet et al. |
| 2010/0015079 | A1 | 1/2010 | Schrader |
| 2011/0017227 | A1 | 1/2011 | Samain |
| 2014/0352714 | A1 | 12/2014 | Samain |
| 2014/0366904 | A1 | 12/2014 | Samain |

FOREIGN PATENT DOCUMENTS

| | | | |
|---|---|---|---|
| EP | 1 656 853 | A1 | 5/2006 |
| GB | 2 234 758 | A | 2/1991 |
| JP | 1-311012 | | 12/1989 |
| JP | 2002-47152 | | 2/2002 |
| JP | 2003-26555 | A | 1/2003 |
| JP | 2004-149417 | A | 5/2004 |
| WO | 03/041531 | A1 | 5/2003 |
| WO | 2009/074957 | A1 | 6/2009 |

OTHER PUBLICATIONS

International Search Report and the Written Opinion for International Application No. PCT/IB2012/057424, dated Mar. 7, 2013.
Preliminary Search Report and Written Opinion for French Application No. 1162082 dated Oct. 3, 2012, with machine-generated English translation.
International Search Report and the Written Opinion for International Application No. PCT/IB2012/057429, dated Mar. 14, 2013.
Preliminary Search Report and Written Opinion for French Application No. 1161997 dated Aug. 17, 2012, with machine-generated English language translation.
Office Action issued in Japanese Application No. 2014-548296 dated Oct. 31, 2016 (with Machine Translation).
Office Action issued in related Japanese Application No. 2014-548295 dated Dec. 5, 2016 (with Machine Translation).

* cited by examiner

COSMETIC APPLICATION ELEMENT

This is a national stage application of PCT/IB2012/057429, filed internationally on Dec. 18, 2012, which claims priority to French Application No. FR 1161997, filed Dec. 20, 2011, and U.S. Provisional Application No. 61/604,921, filed Feb. 29, 2012, the entire disclosures of each of which are incorporated herein by reference.

The present invention relates to the field of hair dyeing and more particularly to the production of shadings on the hair.

BACKGROUND

The techniques conventionally used in the field of the dyeing or bleaching of the hair are targeted at obtaining uniform colours or at obtaining locks having a different colour from the remainder of the head of hair.

Trials have been carried out in order to create areas of non-uniformity in the head of hair by applying, along one and the same lock, one colour and then another, for example, a blonde colouration on the first half of the lock and a brown colouration on the second half. The results obtained on conclusion of these trials can be regarded as unattractive and in general comparable to a colouration obtained after regrowth of the hair.

In some cases, as the hair is sensitized, a dyeing treatment can give non-uniform results which may be regarded as unattractive since they are marked by abrupt transitions from one colour to another.

Furthermore, it is known to treat locks in order to confer, on the head of hair, an appearance similar to that produced by exposure to the sun. The hairdresser then isolates a few locks and applies a bleaching agent to them.

In the case of heads of light hair (blonde or dark blonde hair, for example), the result obtained may be regarded as relatively attractive but is often judged to be rather unnatural.

The attractive nature comes from the fact that each bleached lock opens out towards the tips and thus the light hairs are lost somewhat among the other hairs of the tips. By this opening-out effect, the two colours do not contrast with one another to any great extent.

The rather unnatural character comes from the roots. This is because, on approaching the roots, the hairs of the locks become closer with respect to one another, thus producing an effect of bundles which is rather unnatural as a result of a contrast in colours.

Thus, the locks may give a relatively natural appearance at the tips and at mid-length, while the roots may produce an artificial appearance.

In order to reduce the artificial appearance of the roots, it might be envisaged to decrease the lightening of the hairs of the treated locks. However, such a solution, which reduces the visibility of the lightening, might prove not to be satisfactory. This is because, in order to produce reasonably visible locks, it may be necessary to lighten by approximately 4 tones, such a difference rendering the roots rather unnatural.

Another approach consists in isolating and treating very fine locks. However, this approach is expensive as a result of the time spent by the hairdresser and does not really solve the problem of the visibility of the roots.

Another approach consists in producing the locks starting from the scalp. However, this approach can result in excessive lightening.

There also exists a need to obtain dyed or bleached locks which are thicker and more attractive in order to limit the time spent and to render the service less expensive.

There exists a need to produce locks on heads of dark hair (light chestnut, chestnut, dark chestnut or brown), in particular in order to be able to treat heads of brown hair without having to lighten them beforehand.

The invention is targeted at meeting all or part of the abovementioned needs.

SUMMARY

According to a first of its aspects, the present invention relates to a cosmetic device comprising:

- a support and
- a composition, carried by the support, for dyeing or bleaching the hair, said composition having a formulation that varies depending on the position on the support, so as to allow shaded dyeing or bleaching to be produced on the hair by transfer.

The expression "shaded dyeing or bleaching on the hair" should be understood as meaning dyeing or bleaching of the hair that is delimited by at least two separate regions of colours, it being possible for the hair thus dyed or bleached to have one or more colorimetric coordinates chosen from L, C*, h, a and b, which vary continuously between these two regions.

It is thus possible to obtain shaded dyeing or bleaching such that, between the two separate regions of colours, the dyed or bleached hair exhibits a hue h which varies continuously.

It is also possible to obtain a shaded dyeing or bleaching such that, between the two separate regions of colours, the dyed or bleached hair exhibits a lightness L* which varies continuously.

More particularly, shadings on the hair ranging:

- from light or dark or vice versa according to one and the same tone,
- from one tone to another with an equivalent lightness, or one of their combinations, can be regarded as particularly attractive.

As described in detail below, the variation in the colorimetric coordinate between the two regions may or may not be even.

The expression "so as to allow shaded dyeing or bleaching to be produced on the hair by transfer" should be understood as meaning that it is possible to produce the shaded dyeing or bleaching by bringing the cosmetic device into direct contact with the hair or by bringing the latter into contact with an applicator which has previously collected all or part of the composition initially present on said cosmetic device.

As described in detail below, the dyeing or bleaching of the hair that is produced by transfer is obtained, in a preferred variant, after a solvent has been brought into contact with the dyeing or bleaching composition carried by the support, in order to ensure that it is dissolved and thus to allow it to be transferred onto the hair.

In particular, when the composition is collected, it is preferable that the collection respects the spatial development of the dyeing or bleaching property of the composition on the support; the use of a rotary applicator, such as a roller, is thus preferred, the circumference of the roller being, for example, greater than or equal to the length of the shading to be produced.

The cosmetic device according to the invention makes it possible to easily obtain shaded dyeing or bleaching of the hair, in particular of the locks, creating, for example, bleaching which starts from 2 tones at the roots up to 4 tones or more towards the tips.

For the record, the tones measure the lightness of the hair on a scale from 1 to 10, the value 1 corresponding to black and the value 10 to platinum blonde. The values 3, 5 and 7 correspond respectively to brown, chestnut and dark blonde.

The composition present on the support may contain two colourants in variable proportions depending on their position on the support.

The shading can thus be obtained by a gradual bleaching of the hair, when the progression is towards the root or towards the tip, the composition being a bleaching composition.

According to another of its aspects, the present invention relates to a cosmetic assembly comprising:

a cosmetic device as defined above, and an applicator, in particular a roller, intended to collect all or part of said composition.

Alternatively, the assembly according to the invention comprises, instead of or in combination with the applicator, a solvent, preferably water or aqueous hydrogen peroxide solution, for dissolving the dyeing or bleaching composition carried by the support.

The invention also relates to a cosmetic assembly comprising:

a plurality of devices as defined above, which are designed for different lengths of locks and/or for producing different shadings.

According to another of its aspects, the present invention relates to a method for dyeing or bleaching the hair, comprising the step of:

bringing at least one lock of hair into contact with the composition that comes from a device as defined above in order to obtain shaded dyeing or bleaching of the hair.

In one exemplary embodiment, the composition carried by the support is brought directly into contact with the hair.

In this case, after the composition has been brought into contact with the hair, the method according to the invention can comprise a step of closing the support onto the lock treated, for example wrapping the device around the lock treated so as to define a sheath in which the lock is present. Such a step can advantageously make it possible to reduce the risk of the applied composition being transferred to untreated locks, the support playing the role of a protective means.

In a preferred variant, a solvent, preferably water or aqueous hydrogen peroxide solution, for dissolving the dyeing or bleaching composition carried by the support, is brought into contact with said dyeing or bleaching composition in order that the latter is applied by transfer to the hair by contact with the latter.

In one exemplary embodiment, the support used is water-soluble and the method comprises, after the composition carried by the support has been brought into contact with the hair, a step of bringing the support into contact with water or aqueous hydrogen peroxide solution in order to dissolve all or part of said support and to obtain the shaded dyeing or bleaching. In this case, the support may comprise, and in particular consist of, fibres of cellulose derivatives or an acrylate/acrylic copolymer.

Alternatively, the application of the composition by transfer may be carried out, as mentioned above, by way of an applicator. In this case, the method according to the invention may, furthermore, comprise the steps of:

collecting all or part of the composition with the aid of an applicator, in particular a roller, before said composition has been brought into contact with the hair, bringing the composition collected by the applicator into contact with the lock of hair in order to obtain the shaded dyeing or bleaching of the hair.

In a general manner, the shaded dyeing or bleaching obtained can be produced over all or part of the length of one or more lock(s) of hair. The shaded dyeing or bleaching can consequently be carried out on one or more lock(s) of hair from the root to the tip of the hairs treated.

Preferably, the shading extends as far as the root, even if the shadings obtained by the methods according to the invention can start at a point which is not necessarily the root and can terminate at another point which is not the tip.

The shadings can be produced over all or part of the head of hair and in particular on one or more locks It is possible to produce shadings having different appearances depending on the location on the head of hair and/or depending on the composition chosen.

According to another of its aspects, the invention relates to a method for preparing a cosmetic device as described above, comprising the steps of:

arranging a support, and depositing a composition that has a shaded hair dyeing or bleaching power on said support, in particular with the aid of an inkjet printer, of an airbrush or of a hand-operated mixing device, and/or subjecting a quantity of a precursor composition, the hair dyeing or bleaching power of which can vary under the effect of a chemical and/or energy stimulus, to said stimulus in order to develop a dyeing or bleaching property depending on the position on the support.

The precursor composition may be subjected to a non-zero gradient of a stimulus.

The use of a composition that is sensitive to a stimulus and of this stimulus makes it easier to obtain variable dyeing or bleaching properties, in particular properties that vary gradually, this being suitable for the production of a shading. Composition may be deposited and/or the stimulus may be applied depending on the length of at least one lock to be treated.

The stimulus can be luminous, thermal, mechanical and/or chemical, in particular pH or redox.

The stimulus can be applied by a device for applying the stimulus comprising a luminous irradiator and/or a heating member and/or a tank intended to contain the composition.

The device for applying the stimulus is for example in the form of a hand piece. In this case, the user can move the hand piece in relation to the precursor composition and thus expose it to the stimulus to a greater or lesser degree depending on location, so as to locally modify its dyeing or bleaching properties.

The method can in particular comprise the step of exposing the composition to the stimulus differently depending on location, preferably so as to create a gradual variation in its properties.

According to another of its aspects, the present invention also relates to a sheet-like element comprising, in a first region, a deposit of a precursor composition, the hair dyeing or bleaching power of which can vary under the effect of a chemical and/or energy stimulus, and, in a second region, a deposit of a product comprising a developer or inhibitor.

The sheet-like element may be designed to allow the first and second regions to come into total or partial contact, for example by folding over itself. The bringing into contact of the precursor composition and the product comprising the developer or inhibitor may result in a mixture, the dyeing or bleaching properties of which vary along the longitudinal axis of the sheet-like element. Such a mixture makes it possible to produce shaded dyeing or bleaching on the hair by transfer.

The invention also relates to a sheet-like element comprising, in a first region, a deposit of said precursor composition, the mass per unit area of said precursor composition being constant or varying depending on the position in said first region. This mass per unit area can vary in a strictly monotone manner along the longitudinal axis of said first region.

Such a sheet-like element can be integrated within a cosmetic assembly that also comprises a product comprising a developer or inhibitor.

The present invention also relates to a sheet-like element comprising, in a second region, a deposit of a product comprising a developer or inhibitor, the quantity of material per unit area of developer or inhibitor being approximately constant or varying depending on the position in said second region. This quantity of material per unit area can vary in a strictly monotone manner along the longitudinal axis of said second region.

Such an application element can be integrated within a cosmetic assembly that also comprises said precursor composition.

It is possible for said precursor composition and/or the developer or inhibitor to be present in a deactivated form. The method can then comprise a step of activating said precursor composition and/or the developer or inhibitor, for example by subjecting them to a luminous, thermal, chemical and/or mechanical stimulus.

For example, the precursor composition is deposited on a sheet-like element and comprises an alkaline agent, aqueous hydrogen peroxide solution and a powder of a persalt encapsulated in a wax, the melting point of which varies between 40 and 60° C.

The application of a temperature gradient at the sheet-like element may make it possible to release the persalt encapsulated in the wax to a greater or lesser extent and to obtain a deposit having a gradual hair bleaching power, so as to obtain a shading.

According to another aspect, the invention concerns a cosmetic device comprising:

a support, and a composition, carried by the support, for dyeing or bleaching the hair, said composition having a formulation that varies depending on the position on the support, so as to allow progressive shaded dyeing or bleaching to be produced on the hair by transfer.

The expression "progressive shaded dyeing or bleaching on the hair" should be understood as meaning dyeing or bleaching of the hair that is delimited by at least two separate regions of colours and the hair thus dyed or bleached having one or more colorimetric coordinates chosen from L, C*, h, a and b, which are continuous functions or piecewise continuous functions between these two regions.

Shaded Dyeing Obtained

The shaded dyeing or bleaching of the hair that is obtained can comprise first and second regions that have between each other a colour difference ΔE in the CIELab space of greater than or equal to 1, in particular greater than or equal to 3.

Change in the Colour Between the Root and the Tips

At least one colorimetric coordinate chosen from L, C*, a, b and h may change continuously, in particular linearly, along a lock of hair treated by a method according to the invention.

In one exemplary embodiment, at least one of these colorimetric coordinates can change in an asymptotic manner, that is to say that, on moving along a lock of hair treated by a method according to the invention towards a given abscissa, said colorimetric coordinate varies less and less per unit of distance. In other words, on moving along a lock of hair treated by a method according to the invention towards a given abscissa, the derivative of said colorimetric coordinate with respect to the position along the lock becomes less.

For example, in the last three centimeters before said abscissa, said colorimetric coordinate varies by no more than 30% of the amount by which it varied in the three centimeters of a portion 6 centimeters away from said abscissa (between 9 and 6 cm from said abscissa).

Said abscissa may be located in at least one of the following regions:

the region of the shading closest to the root of the hair, the region of the shading closest to the tip of the hair, or a central region.

The production of asymptotic shading on the hair treated is preferred for aesthetic reasons. Preferably, asymptotic shading is produced with a colorimetric coordinate that varies less and less per unit of distance on moving towards a region of the shading close to the root of the hair.

The shadings can be adapted or not adapted to the length of the lock depending on the location on the head of hair.

Thus, the shading obtained on a first lock can, for example, correspond, give or take one homothetic transformation, to the shading obtained on a second lock having a different length from the first lock. The homothetic ratio may, in this case, correspond to the ratio of the length of the first lock divided by the length of the second lock.

Alternatively, it is possible to obtain two identical shadings on two locks of hair having different lengths.

Support

The support is preferably in the form of a sheet-like element, but other embodiments are possible.

The sheet-like element may comprise, and in particular consist of, a plastics material, in particular a thermoplastic, a paper, a metal, in particular aluminium, a woven material, a nonwoven material made of cellulose or one of its derivatives, or polyamide 6,6.

Preferably, the sheet-like element is covered by a deposit of adhesive composition, on which the hair dyeing or bleaching composition is present. In this variant, the hair dyeing or bleaching composition is preferably intended to be brought into contact with a solvent in order to dissolve it and thus allow it to be transferred onto the hair.

The sheet-like element may comprise, and in particular consist of, a water-soluble material, this making it possible, for example, to remove it by washing the hair.

Preferably, the sheet-like element comprises an assembly of a layer of a water-soluble material and a layer of a non-water-soluble material, for example an aluminium foil.

The support can be designed to be able to be closed around a lock of hair. It is for example provided with a fastening means for keeping it in such a state, for example an adhesive disposed close to one edge or a mechanical attachment relief.

The support may comprise a housing in which the composition is present.

The composition carried by the support may be in a set form, in particular in the form of a gel, in order to avoid it flowing under the effect of its own weight.

Stimulus

The composition present on the support may develop a dyeing or bleaching property on account of its exposure to a stimulus.

In particular, the composition may, in the precursor state, be subjected to a non-zero gradient of a stimulus. It is possible, for example, to subject said composition, deposited on the cosmetic device, to a variation, in at least one direction, in a value that characterizes the stimulus.

All of the precursor composition may be subjected, at the same time, to a spatially inhomogeneous stimulus, such that some regions of the mass of precursor composition are more exposed to the stimulus than others, thereby causing the dyeing or bleaching properties of the composition to vary.

The precursor composition may also be subjected to a stimulus which varies over time depending on the regions exposed and/or which subjects certain regions to the stimulus for a longer time than others. In this case, the mass of precursor composition may receive over time an exposure to the stimulus which varies depending on the location on the support.

Luminous and/or Thermal Stimulus

In one exemplary embodiment, the precursor composition is subjected to a non-zero temperature gradient.

In this case, a first region of a deposit of precursor composition can be brought to a first temperature while a second region, separate from the first, can be brought to a second temperature that is different from the first.

The precursor composition is then chosen so as to have dyeing or bleaching properties that vary depending on the temperature, on account, for example, of the use of a compound encapsulated in a wax or on account of a modification of the kinetics of a reaction.

The non-zero temperature gradient may, in particular, be generated by application of infrared radiation or by bringing into contact with a heating surface having a non-uniform temperature.

The temperature gradient is obtained for example by having more numerous or more powerful infrared radiation sources at one location than at another.

In the case of a heating surface, the heat is for example released by at least one resistive element through which an electric current passes with a non-uniform distribution of this resistive element.

As described in more detail below, the precursor composition may also initially be present in a reservoir of a device for applying the stimulus, which ensures its distribution. In one exemplary embodiment, the device for applying the stimulus may bring a first part of the precursor composition to a first temperature in a first region in order to obtain a first fraction of composition on the support with a particular dyeing or bleaching property. The device for applying the stimulus may then carry out a relative movement with respect to the support and then bring a second part of the precursor composition to a second temperature, which is different from the first temperature, in a second region of the support, which is separate from the first region, in order to obtain a second fraction of composition on the support with a dyeing or bleaching property that is different from the first.

The precursor composition may then be subjected, in a first position on the support, to first radiation having a first dominant wavelength and be subjected, in a second position, to second radiation having a second dominant wavelength that is different from the first. These different wavelengths may induce one or more different reactions within the precursor composition, for example catalyse a reaction to a greater or lesser extent, and thus cause the variation in the dyeing or bleaching properties. In one exemplary embodiment, a first fraction of composition may be obtained after the precursor composition has been subjected to first radiation for a first exposure time and a second fraction of composition having a dyeing or bleaching property that is different from the first may be obtained by subjecting the precursor composition to second radiation for a second exposure time that is different from the first. In this case, the spectra of the first and second radiations may be different or identical.

In one exemplary embodiment, a first fraction of composition may be obtained by subjecting the precursor composition to first radiation having a first energy flow and a second fraction of composition, having a dyeing or bleaching property that is different from the first, may be obtained by subjecting the precursor composition to second radiation having a second energy flow that is different from the first.

In one exemplary embodiment, a first fraction may be obtained by subjecting the precursor composition to first radiation having a spectral energy density curve that has a first full width at half maximum for a given wavelength, and a second fraction, having a dyeing or bleaching property that is different from the first, may be obtained by subjecting the precursor composition to second radiation having a spectral energy density curve that has a second full width at half maximum for this wavelength, the second full width at half maximum being different from the first.

The luminous and/or thermal stimulus may, for example, comprise ultraviolet radiation. In this case, the precursor composition may be a photodevelopable composition, in particular involving an irreversible colour change.

Chemical Stimulus

The stimulus may be chemical and the composition may be prepared by bringing the precursor composition into contact with a developer or inhibitor, in particular an oxidizing agent or reducing agent, such that a non-zero gradient of quantity of material and/or time of exposure to developer or inhibitor is applied. Thus, it is possible to obtain a mass of composition having bleaching or dyeing properties that vary spatially.

When oxidation dyeing is intended to be produced, the developer may be an alkaline agent or a metal catalyst and the inhibitor may be an acid agent, a complexing agent, a disproportionation agent of the developer or a reducing agent.

The oxidizing agent may be hydrogen peroxide, an organic peroxide such as benzoyl peroxide, a peracid such as peracetic acid, a halogen oxide, a persalt agent such as persilicate, perborate, or a peroxide metal salt such as potassium permanganate.

The developer or inhibitor can make it possible to vary the pH of the composition. Specifically, a pH rise can make it possible to increase the bleaching power and a pH drop can make it possible to decrease the bleaching power.

Mechanical Stimulus

In this case, the method according to the invention may comprise the steps of:

applying a precursor composition to a support, and imposing a mechanical load on said precursor composition so as to obtain the composition for producing shaded dyeing or bleaching on the hair by transfer.

The mechanical load may be applied in a spatially non-uniform manner in the region of a deposit of said precursor composition. The mechanical load has, for example, variable intensity depending on the position on the deposit.

It is possible to use a support that initially comprises a dyeing or bleaching agent present in pressure-sensitive capsules.

Alternatively, use is made of a support that initially comprises a dyeing or bleaching agent and capsules that comprise a pressure-sensitive accelerator or inhibitor, such as an alkaline agent, a complexing agent, a reducing agent, an acidifier or a catalyst.

In the two last cases, a mechanical load of variable intensity depending on the position on the deposit could be imposed in order to burst more or fewer capsules and thus obtain the desired shaded dyeing or bleaching power of the hair.

Device for Applying the Stimulus

The method according to the invention may comprise a step of determining the position of the device for applying the stimulus in relation to the support to which the composition is intended to be applied or is applied.

Such a step can advantageously make it easier to apply the stimulus which is locally suitable for obtaining the dyeing or bleaching that is desired.

The position of the device for applying the stimulus in relation to the support can be determined in various ways, for example by virtue of motorized driving of the support in relation to the device for applying the stimulus and/or for dispensing the composition.

DESCRIPTION OF THE FIGURES

The invention may be better understood from reading the following detailed description of non-limiting implementation examples thereof and from examining the appended drawing, in which.

Figure 1:
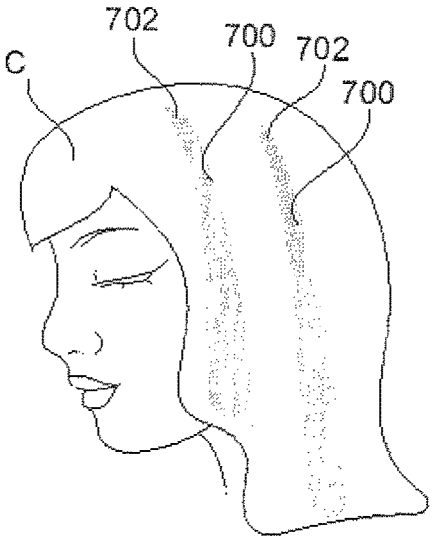
FIG. 1 schematically shows the production of dyeing known from the prior art, FIG. 2 schematically shows the production of shaded dyeing according to the invention, FIGS. 3A and 3B schematically illustrate the variation in colorimetric characteristics within shadings according to the invention, FIGS. 4A and 4B schematically illustrate the variation in stimuli applied in order to obtain cosmetic devices according to the invention, FIGS. 5A and 5B schematically show various types of shaded dyeings obtained by implementing a method according to the invention, FIG. 6 schematically and partially shows a cosmetic device according to the invention.

In the drawing, the actual relative proportions have not always been respected, for the sake of clarity.

FIG. 1 schematically illustrates the production, on a head of hair C, of locks 700 having a uniform colour by the implementation of methods known from the prior art. Such locks 700 may, as explained below, have a rather unnatural appearance at the roots 702.

Figure 2:
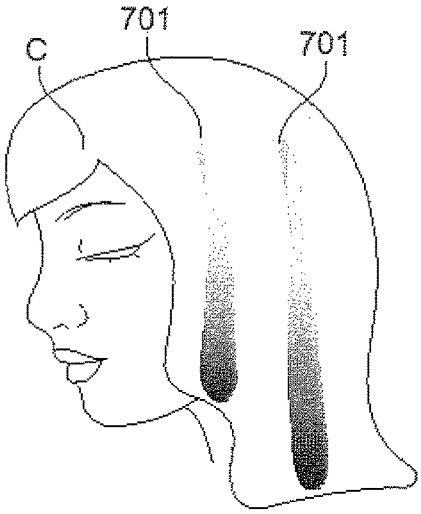

FIG. 2 schematically illustrates the production, on the head of hair C, of shaded locks 701, for example where the tint varies along said locks 701. Such locks 701 are obtained by implementing methods according to the invention.

Figure 5A:
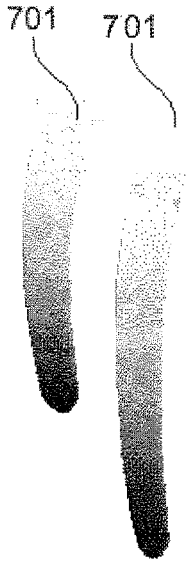
Figure 5B:
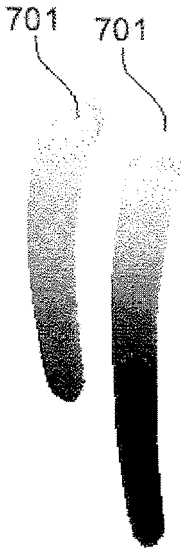

FIGS. 5A and 5B respectively illustrate colour shadings adapted to the length of the locks 701 and shadings that are identical whatever the length of the locks 701. The shadings obtained in FIG. 5A correspond, give or take one homothetic transformation.

Figure 3A:
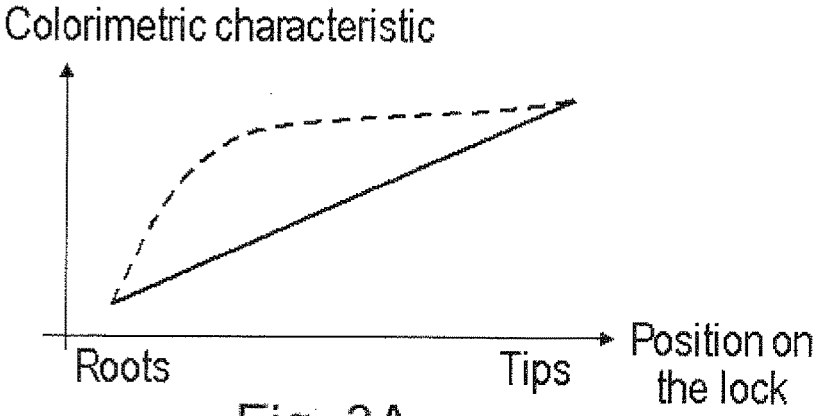
Figure 3B:
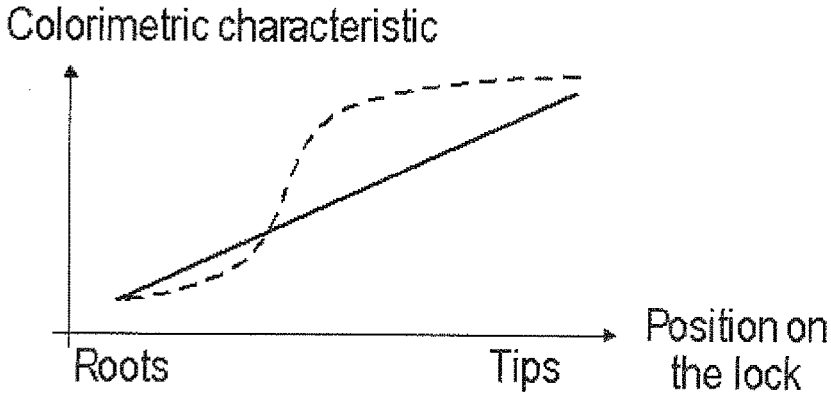

FIGS. 3A and 3B illustrate the variation in colorimetric characteristics along a lock bearing a shading obtained by virtue of the cosmetic devices according to the invention.

As illustrated, this variation can be linear depending on the position along the lock (solid-line curves) or non-linear, in particular asymptotic (dashed lines).

It is possible to obtain, along a lock treated by a method according to the invention, a linear or asymptotic variation of L (clarity) on moving along the lock from the root towards the tip of the hairs.

It is also possible to obtain, along a lock treated by a method according to the invention, an in particular linear or asymptotic variation of C* (saturation) on moving along the lock from the root towards the tip of the hairs.

It is furthermore possible to obtain, along a lock treated by a method according to the invention, an in particular linear or asymptotic variation of a (position on the red/green axis) on moving along the lock from the root towards the tip of the hairs, or of b (position on the blue/yellow axis) or of h (tint).

One or more colorimetric characteristics chosen from; L, C*, h, a and b may thus vary along the lock of hair treated.

It is possible to obtain dyeing, along a lock, which varies in "tones", the hairs receiving for example at least one bleaching tone.

When it is desired to treat half or more of the hairs, the shading can advantageously follow a sigmoid variation (dashed curve in FIG. 3B).

The variation in the colorimetric characteristic of such a shading is concentrated in the mid-region of the length of the hairs and can make it possible to avoid the effects of roots and tips.

It is possible, for example, to obtain a colour in the region of the roots that is relatively close to the colour visible at the roots before the method according to the invention is implemented. In particular, it is possible to obtain a colour in the region of the roots that is nuanced, in particular lightened, by 2 tones with respect to the colour visible at the roots before the method according to the invention is implemented.

It is possible, for example, to obtain a colour in the region of the tips that is significantly different from the colour visible at the tips before the method according to the invention is implemented. In particular, it is possible to obtain a colour in the region of the tips that is nuanced, in particular lightened, by 4 tones or more with respect to the colour visible at the tips before the method according to the invention is implemented.

The production of the desired variation in the dyeing or bleaching property of the composition on the support depending on the position on the support depends on the way in which the composition acts on the hair in order to dye or bleach it. A dyeing or bleaching property of the composition 10 may vary continuously depending on the position on the support 2, in particular by way of a linear or asymptotic variation.

In the case for example in which the composition comprises a colourant, the quantity of colourant can vary along the support, decreasing towards one end. In the case of two colourants, the quantity of one of the colourants can decrease towards one end of the support while the quantity of the other colourant decreases towards the other end of the support. The decrease can be linear or non-linear, depending on whether the shading desired is asymptotic, in particular sigmoid, shading or linear shading.

In the case in which the composition was obtained with the aid of a precursor exposed to a stimulus, the development of the latter makes it possible to control the development of the dyeing or bleaching property of the composition.

Figure 4A:
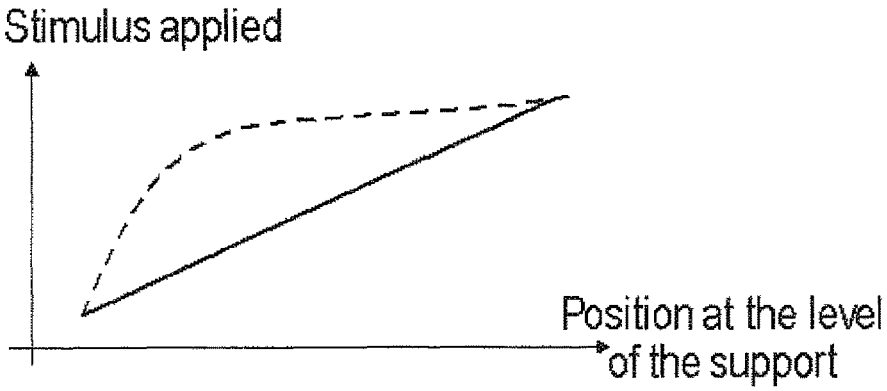
Figure 4B:
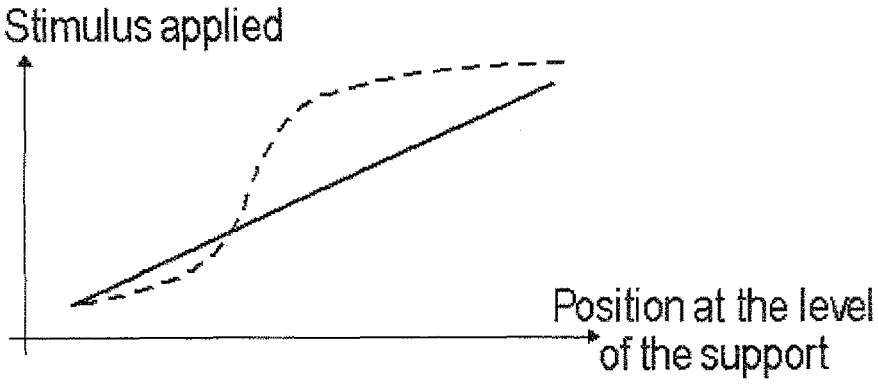

FIGS. 4A and 4B show examples of the development of the stimuli applied along the support in the context of methods for preparing cosmetic devices according to the invention that are based on the application of a stimulus.

It is possible, for example, to have a linear or asymptotic variation in the temperature to which the precursor composition is subjected depending on the position along the support.

Alternatively, it is possible to deposit a quantity of developer or inhibitor which varies in a linear or asymptotic manner depending on the position along the support.

The application of such gradients can allow shaded hair dyeing or bleaching powers to be obtained, as described in detail below.

Figure 6:
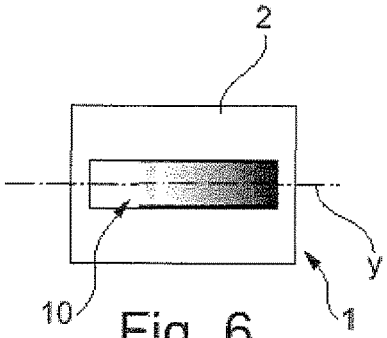
FIG. 6*a* shows a variant embodiment of the device from FIG. 6, FIG. 7 schematically and partially shows a variant cosmetic device according to the invention.

FIG. 6 shows an example of a cosmetic device 1 according to the invention. This device 1 comprises a support 2 in the form of a sheet-like element, on which there is present a deposit of dyeing or bleaching composition 10. The deposit of composition 10 may be fixed to the support by way of a deposit of an adhesive composition, extends along a longitudinal axis Y and has a shaded hair dyeing or bleaching power. In the variant illustrated, the axis Y also corresponds to the longitudinal axis of the support 2.

Figure 6A:
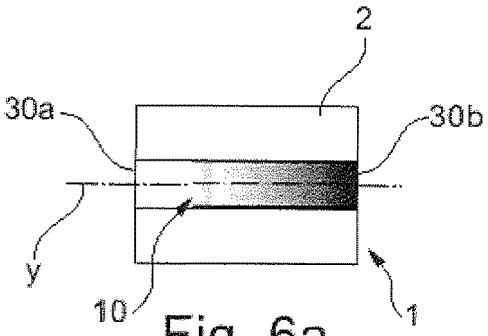

The variant illustrated in FIG. 6*a* shows an exemplary embodiment in which the deposit of composition 10 extends along the longitudinal axis Y from a first end 30*a* to a second end 30*b* of the support 2.

Figure 7:
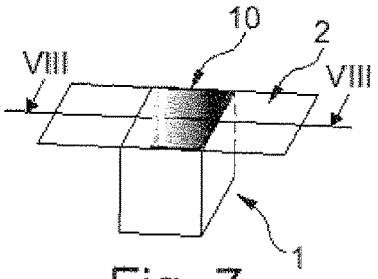
Figure 8:
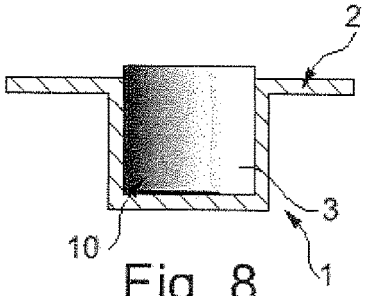
FIG. 8 shows a section along VIII-VIII of the device from FIG. 7, FIGS. 9 to 14 show exemplary embodiments of methods according to the invention, FIG. 15 schematically and partially shows a result obtained from the methods described in FIGS. 9 to 14.

FIGS. 7 and 8 show a variant embodiment in which the cosmetic device 1 comprises a support 2 comprising a housing 3 in which the composition 10 is present. In this exemplary embodiment, the composition 10 is preferably in a set form, in particular in the form of a gel.

In the examples illustrated, at least one colorimetric coordinate of the deposit of composition 10 varies continuously depending on the position on the support 2. For example, the tint of the composition 10 varies continuously along the longitudinal axis Y of the support 2.

Alternatively, the oxidizing or reducing power of the composition 10 varies continuously depending on the position on the support 2.

The support 2 may be elongate and the reducing or oxidizing power and/or the colour of the composition 10 may vary continuously along the longitudinal axis Y of the support 2.

Figure 9:
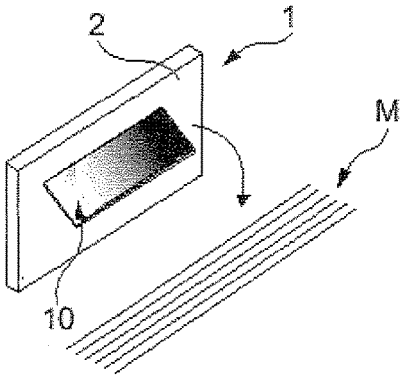

FIG. 9 illustrates the transfer of the composition 10 present on the device 1 onto a lock M of hair. In this example, the device 1 is moved towards the lock M to be treated and the composition 10 carried by the support 2 is brought directly into contact with the hairs to be treated. In this case, it is possible, before contact is made with the lock M to be treated, to bring the composition 10 into contact with a solvent, preferably water or aqueous hydrogen peroxide solution, for dissolving it and transferring it onto the lock M.

Figure 10:
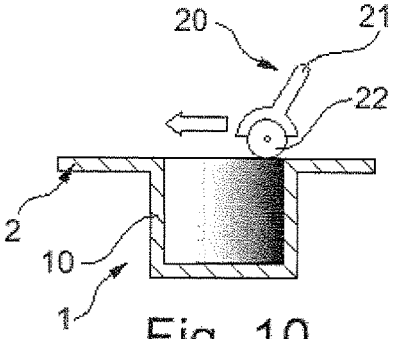

FIG. 10 illustrates the collecting of the composition on the device 1 from FIGS. 7 and 8 by virtue of an applicator 20 that has a roller 22 which the user rolls, as a first step, on the composition 10. The applicator comprises a gripping part 21.

Figure 11:
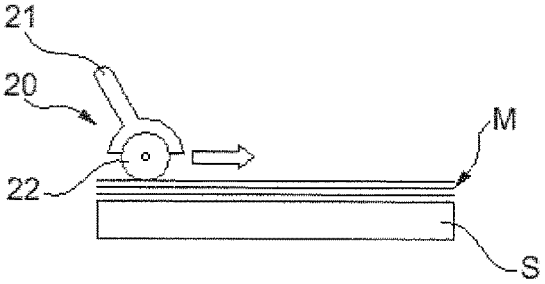

The roller 20 is then moved along the lock M in order to deposit the composition 10 thereon and to obtain the shaded dyeing or bleaching, as illustrated in FIG. 11.

Figure 12:
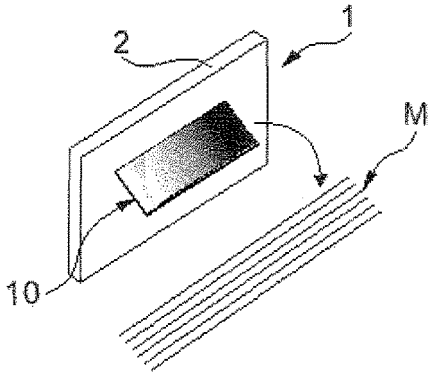
Figure 13:
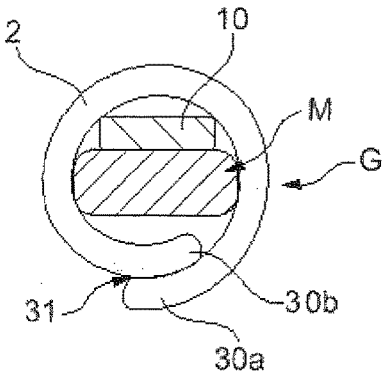

FIGS. 12 and 13 show an exemplary embodiment in which the device 1 is moved towards the lock M to be treated in order to bring the composition 10 into contact with the hair. The support 2 is then folded over itself so as to form a tubular sheath G. The support 2 may comprise at a first end 30*a* an adhesive deposit 31 for fixing the first end 30*a* to a second end 30*b* so as to form the sheath G. The sheath G can advantageously limit the risks of transferring the composition 10 onto untreated locks.

Figure 14:
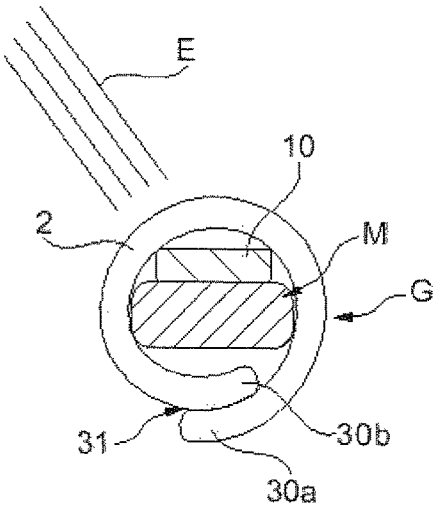

FIG. 14 shows an exemplary embodiment in which the support 2 is water-soluble. A tubular sheath G has for example been formed in the same way as in FIG. 13. However, in this example, a step of bringing the support 2 into contact with aqueous hydrogen peroxide solution is carried out in order to eliminate said support and obtain the shaded dyeing or bleaching.

Figure 15:
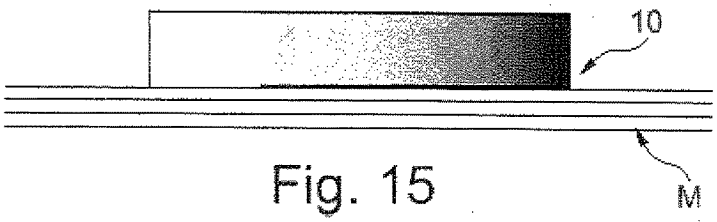

FIG. 15 illustrates a deposit of composition 10 obtained by the methods illustrated in FIGS. 9 to 14 and allowing shaded dyeing or bleaching to be obtained on the hair.

Figure 16:
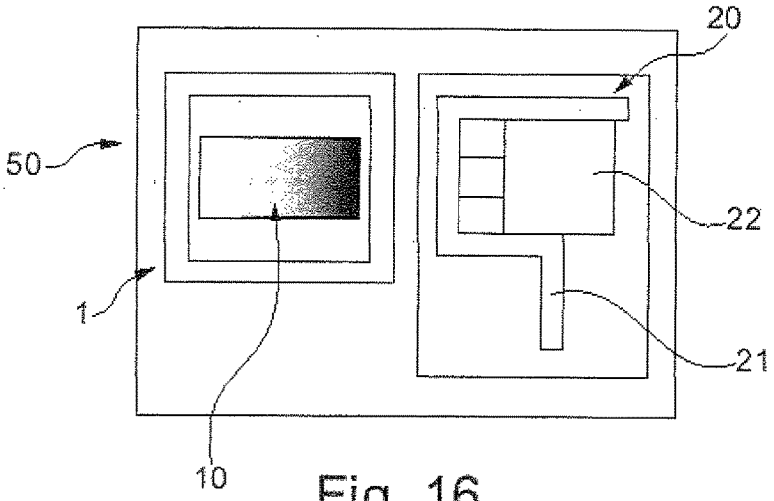
FIG. 16 shows an example of an assembly according to the invention.

FIG. 16 shows an example of an assembly 50 according to the invention, comprising a device 1 according to the invention and an applicator 20 intended to collect all or part of the composition 10 present on said device 1.

Various methods for preparing the device 1 according to the invention will now be described.

Figure 17:
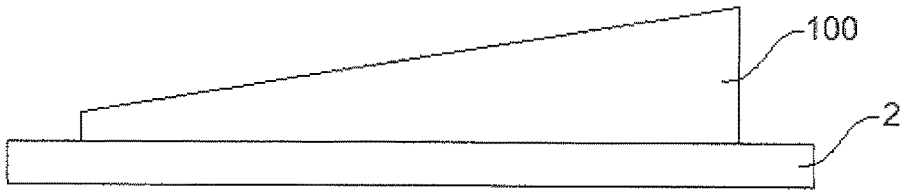
FIGS. 17 to 28 show examples of methods for preparing devices according to the invention, FIG. 29 schematically shows a perspective view of an example of a dispensing device designed to deposit a composition that has a shaded hair dyeing or bleaching power.
Figure 18:
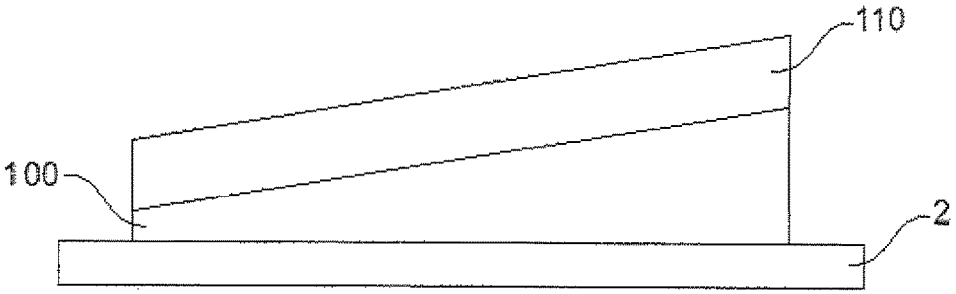
Figure 19:
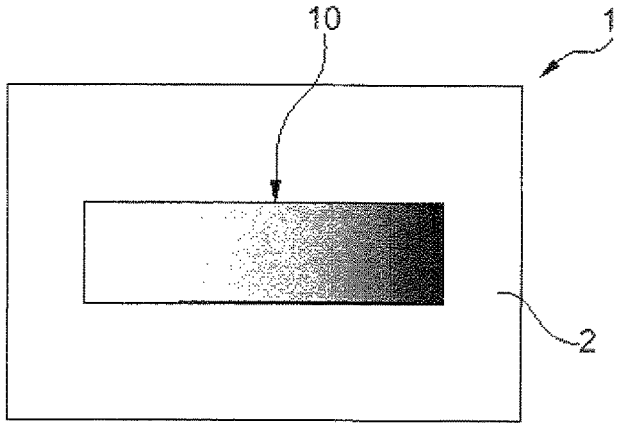

FIGS. 17 to 19 illustrate a method for preparing a cosmetic device 1 according to the invention by bringing a precursor composition 100, the hair dyeing power of which can vary, into contact with an oxidizing agent 110.

As shown in FIG. 17, a non-uniform quantity of composition 100 has been applied to the support 2, the quantity of composition 100 deposited increasing for example linearly along the longitudinal axis of the support.

In a second step, the oxidizing agent 110 is brought into contact with the deposit of composition 100. During this step, which is illustrated in FIG. 18, the quantity of oxidizing agent 110 applied is constant along the longitudinal axis of the support 2.

In these exemplary embodiments, the thicknesses of the deposits of oxidizing agent 110 and composition 100 have been exaggerated for the sake of clarity of the drawing.

It may be possible to deposit a variable quantity of oxidizing agent 110 along the longitudinal axis of the support 2. It may also be possible to deposit a constant quantity of composition 100 along the longitudinal axis of the support 2 and a variable quantity of oxidizing agent 110 along the longitudinal axis of the support 2.

The variable quantities of oxidizing agent 110 or of composition 100 can be deposited along the longitudinal axis of the support 2 by being transferred from an applicator element or by spraying, the outlet flow rate being modified depending on the position on the support 2. The variable quantity can also be applied by an applicator roller which uses up composition to be applied as it moves along the longitudinal axis of the support 2.

Alternatively, it is possible to apply a constant quantity of composition 100 and a constant quantity of oxidizing agent 110 and to vary the exposure time depending on the position on the support 2 in order to obtain a shaded dyeing or bleaching power.

Alternatively, it is possible to first of all apply the oxidizing agent 110 to the support 2 and then apply the composition 100. Of course, the embodiments described above apply mutatis mutandis to this variant.

FIG. 19 illustrates the production of a cosmetic device 1 according to the invention, comprising a deposit of composition 10 having a shaded hair dyeing or bleaching power.

Figure 20:
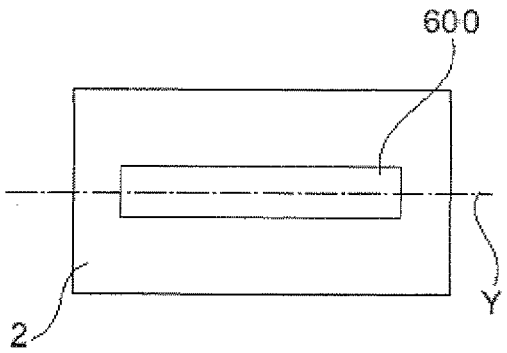
Figure 21:
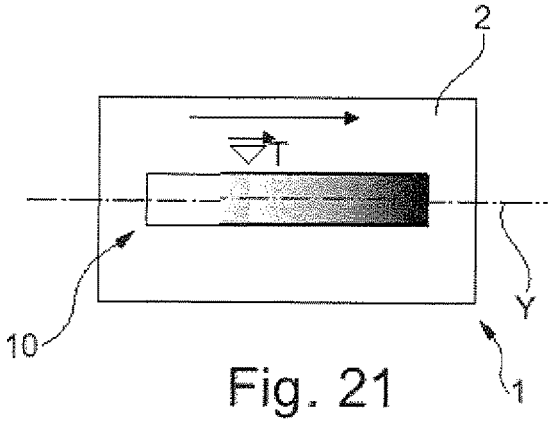

FIGS. 20 and 21 illustrate another exemplary embodiment of a method for preparing a cosmetic device 1 according to the invention.

A deposit of precursor composition 600, the hair dyeing power of which can vary depending on the temperature, is present on a support 2 as illustrated in FIG. 20.

Furthermore, the support 2 comprises heating means (not shown) for obtaining a non-zero temperature gradient in at least one direction.

FIG. 21 shows the production of a deposit of composition 10 after the temperature gradient has been applied to the support. Preferably, the dyeing and bleaching power varies continuously along the axis Y.

Figure 22:
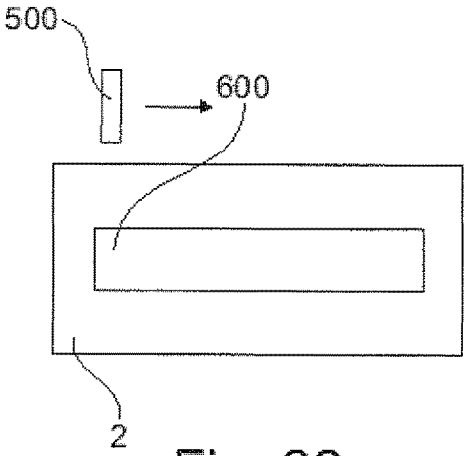
Figure 23:
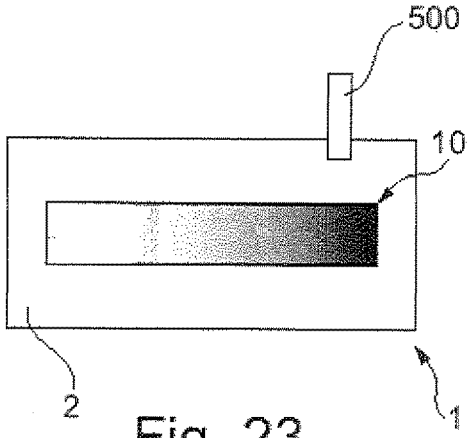

As a variant, FIGS. 22 and 23 illustrate the production of a deposit of composition 10 by applying a non-zero temperature gradient by virtue of an external heating member 500.

In the configuration in FIG. 22, the heating member 500 subjects the composition 600 to a first temperature. The heating member 500 is then moved with respect to the deposit of composition 600 in order to be moved into the position illustrated in FIG. 23, in which it subjects the composition 600 to a second temperature which is different from the first. In the meantime, it has subjected the composition to intermediate temperatures. Alternatively, the time of exposure to the heating member, brought to a constant temperature, varies but the length of time for positioning at a given position varies, so as to locally heat the composition to a greater or lesser degree, taking its thermal inertia into account.

Figure 24:
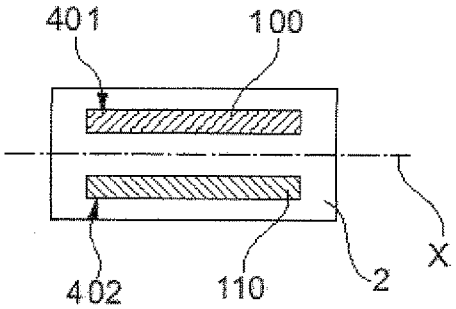

FIG. 24 shows a sheet-like element comprising a support 2 that can be folded along the axis X.

In a first region 401, the support comprises a deposit of composition 100 and in a second region 402 it comprises a deposit of an oxidizing agent 110.

The quantities of composition 100 and of oxidizing agent 110 can vary or be constant depending on the position in the first or second regions 401 and 402 along the axis X.

Figure 25:
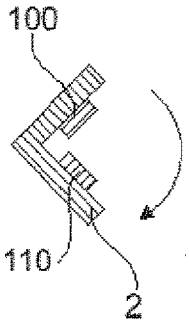
Figure 26:
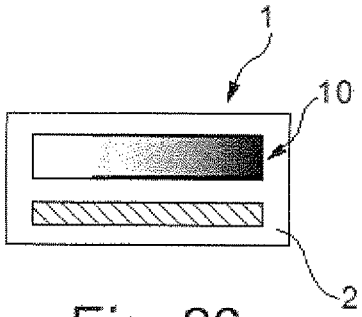

FIG. 25 shows the step of folding the support 2 around the axis X that leads to the composition 100 being brought into contact with the oxidizing agent 110. The result of this bringing into contact is illustrated in FIG. 26, where a deposit of composition 10 is obtained.

Figure 27:
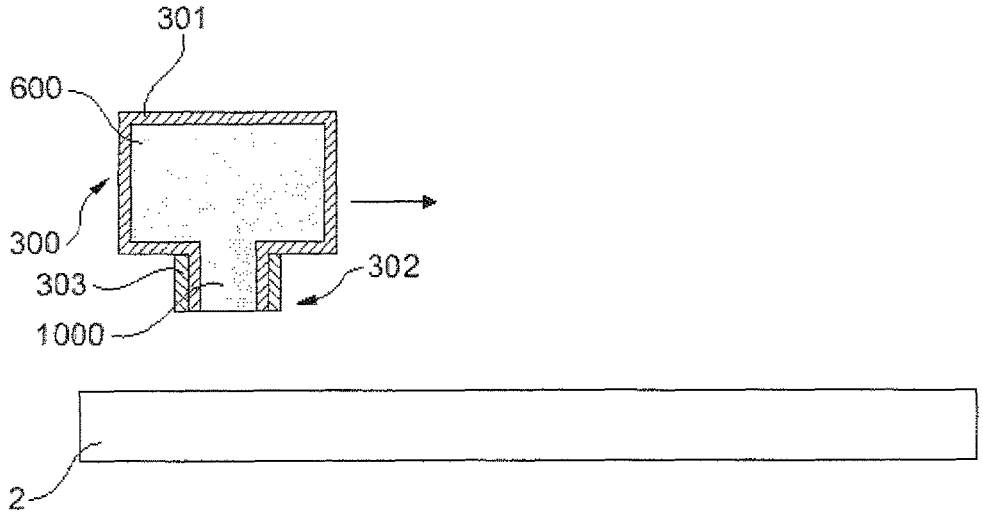
Figure 28:
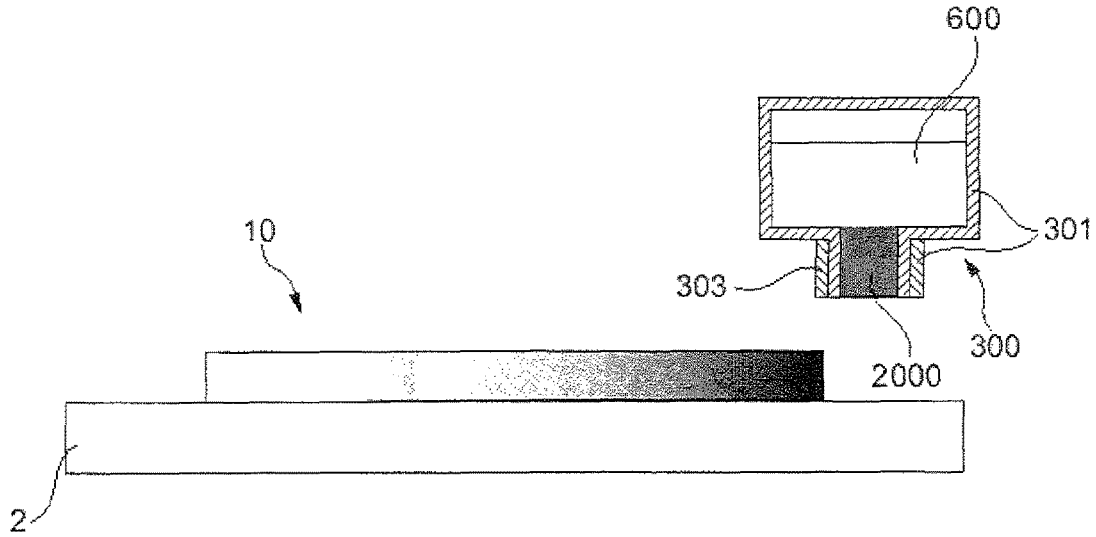

FIGS. 27 and 28 show a variant in which a device 300 for applying the stimulus comprises, within a reservoir delimited by a wall 301, a composition 600 intended to be applied to a support 2. The device for applying the stimulus comprises an applicator nozzle 302 through which the composition 600 is intended to be dispensed onto the support 2. In the example illustrated in FIG. 27, a heating member 303 is present in the region of the applicator nozzle 302.

When the composition 600 is present in the region of the applicator nozzle 302, the composition is brought to a first temperature that allows a fraction 1000 of composition having a first dyeing power to be obtained, as shown in FIG. 27. This fraction is then dispensed onto the support 2.

The device 300 for applying the stimulus is then moved in relation to the support 2 and can repeat various dispensing operations, the heating member 303, each time, being brought to a different temperature.

Following a number of dispensing operations, a deposit of composition 10 having a hair dyeing power that varies along the support 2 is obtained on the lock M. The temperature is varied preferably continuously.

It is possible in this exemplary embodiment to replace the heating member 303 with a device for dispensing an oxidizing agent in controlled quantities, the composition having, in this case, a variable dyeing power by being brought into contact with an oxidizing agent.

The variation in the hair dyeing or bleaching power of the composition can be obtained by subjecting it to radiation.

For example, the composition may be a photochromic composition that is revealable under the effect of radiation having a given wavelength and the shading can be obtained by applying light radiation the spectral energy density of which close to this wavelength increases along the support 2.

Figure 29:
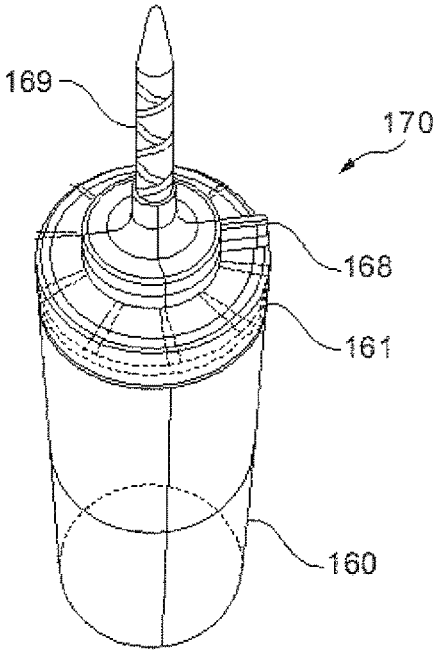

FIG. 29 shows an example of a hand-operated device 170 for preparing and dispensing a composition that has a shaded dyeing or bleaching power. The body 160 defines two reservoirs and the user can apply pressure thereto in order to dispense the contents. A dispensing head 161 mixes the contents of the reservoirs in variable proportions. The reservoirs open for example through supply orifices 162 and 163 opposite an adjusting part that has two outlet orifices 164 and 165 that can be superposed more or less on the supply orifices depending on the position of this part with respect to the body 160. Thus, for the three relative positions illustrated in FIG. 30, the components are dispensed respectively in the proportions (expressed in %) of 100/0, 50/50, 0/100. The part which acts on the flow rate in each of the components may be able to rotate about the longitudinal axis of the device and may, if need be, be moved automatically by an elastic return member which cannot be seen and which can be stressed initially by the user by virtue of an operating handle 168. Alternatively, the operating handle 168 controls the position of the adjusting member and is actuated by the user during dispensing in order to vary the formulation of the mixture.

In the presence of an elastic return member, a brake, for example of the viscoelastic fluid type, can be rotated with the part for adjusting the flow rate such that the movement of the adjusting part under the action of the elastic return member does not occur too quickly.

Figure 30:
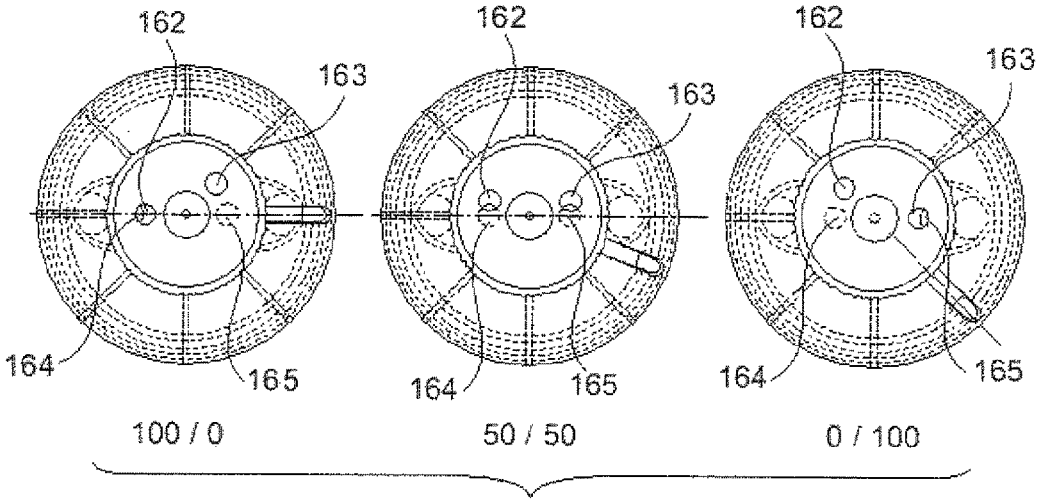
FIG. 30 illustrates various positions of the adjusting member of the device from FIG. 29 and the sections of corresponding passages for the products intended to be mixed.

In order to use the system illustrated in FIGS. 29 and 30, the user actuates the operating handle 168 in order to stress the elastic return member and then releases it. The adjusting part then moves automatically under the action of the return member for a predefined length of time, during which the user applies pressure to the reservoirs in order to force the products to pass through the dispensing head. Alternatively, in the absence of an elastic return member, the user moves the operating handle 168 in order to change the formulation.

The formulation of the composition which is dispensed varies, said formulation resulting from the mixing of the components in a cannula 169 provided with a mixer for example having propellers that have opposite pitches. The user moves the cannula in relation to the intermediate support on which the composition is deposited. In this way, he obtains a deposit of composition, the dyeing or bleaching property of which varies longitudinally.

EXAMPLES

Example 1

Figure 31:
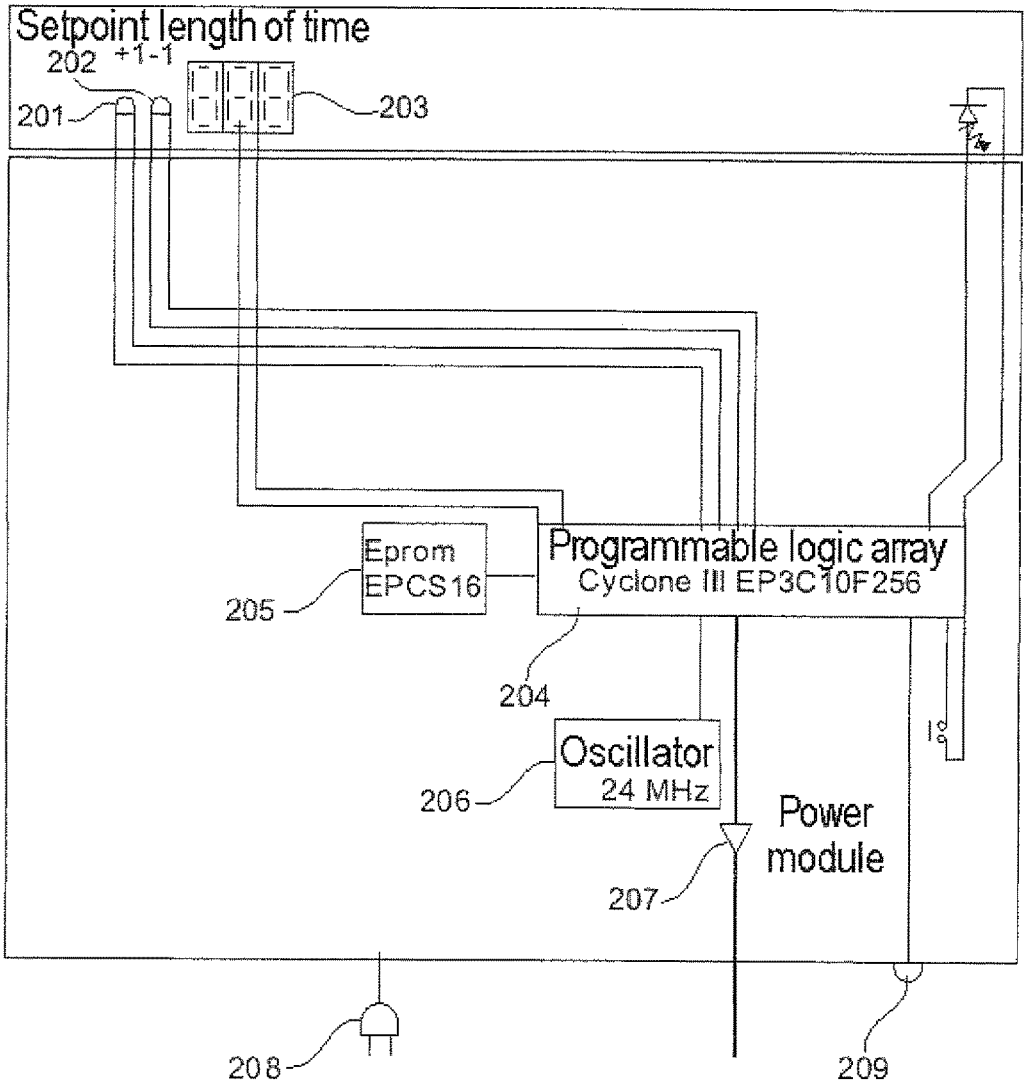
FIG. 31 is an electronic diagram of an example of a control unit.
Figure 32:
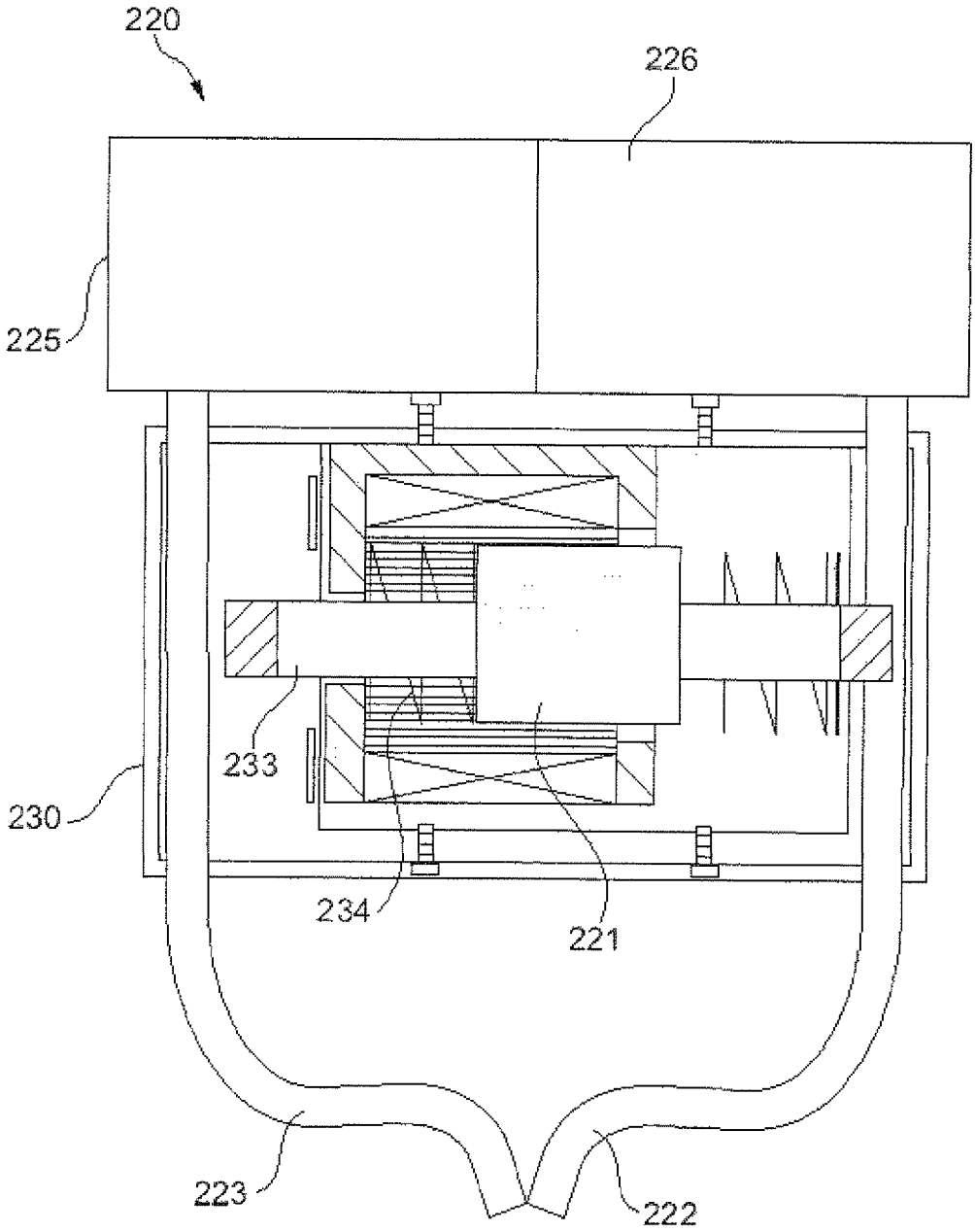
FIG. 32 is an example of a device controlled by the control unit for dispensing a composition having a variable formulation.

The following assembly is carried out, corresponding to FIGS. 31 and 32.

a) First Part Called the "Fixed Casing"

The following elements are incorporated into this first part:

- A façade carrying 2 push buttons 201 and 202 and 1 liquid crystal display 203, which are connected to a logic network 204 by a serial link.
- A printed circuit board comprising the programmable logic network 204, its Eprom 205, a, for example, 24 MHz oscillator 206, a power module 207, a power supply, an on/off button 209.
- A general power supply 208.

The programmable logic network has for example the reference Cyclone III EPC 3 from Altera and carries out a number of functions:

1) sensing the state of the 2 adjusting buttons 201 and 202. Each button advances, either by incremental or decremental step changes, an 8 bit register called $t_{setpoint}$.

2) sending to the liquid crystal display 203 the value of a register $t_{setpoint}$. Sending is carried out by a serial link in the form of ASCII code.

3) the logic network 204 is connected to the power module 207 integrated into the printed circuit. It consists of an operational amplifier and a power transistor stage that can generate currents of several amps. This power module is capable of setting a print head into motion.

4) a calculation and a comparison operation:

As soon as the operator presses the on/off button, the network calculates a 16 bit register "$d_{setpoint}$" where $d_{setpoint}=255 \cdot t_{setpoint}$. Next, he incrementally advances a 16 bit register "$d_{action}$" from 0 to $d_{setpoint}$. When he reaches $d_{setpoint}$ he incrementally advances an 8 bit register $V_{action}$, incrementally advances an 8 bit register "I" and resets $d_{action}$ to 0. He compares I with 16. As soon as I reaches 16, he waits for 10 seconds before resetting all the registers to zero.

During these calculation operations, the logic network instructs the power module to impose a voltage of I/8 amps (from 0 to 2 A). The Cyclone III is clocked by the 24 MHz oscillator and connected to the Eprom, which has for example the reference EPCS16 from Altera. Thus, when power is applied to the apparatus, the program which controls the actions of the logic network is transferred from this Eprom to the logic network.

b) Second "Slidable" Part

A dispensing head 220 as illustrated in FIG. 32 is produced, comprising an electromagnet 221 supplied by the abovementioned power module 207.

Through the head 220 there pass two flexible tubes 222 and 223, through which there passes a fluid that can be pressurized. For example, the fluids are stored in compartments made of flexible plastic that form the first reservoir 225 and second reservoir 226 and can be squeezed by hand. The two flexible tubes are held by a case 230.

When it is powered, the electromagnet 221 pushes a compression bar 233 against at least one return spring 234. Thus, when the electromagnet is not powered, the tube 222 is compressed and the tube 223 is not compressed. The more power is supplied to the electromagnet, the more the tube 223 is compressed and the more the tube 222 is released. The two tubes 222 and 223 open towards one and the same outlet, supplemented by a baffle mixing system. The assembly formed by the delivery head and the two reservoirs belongs to the part of the system that can be moved by the user, also known as hand piece.

c) Operation

The two reservoirs are filled respectively with a first colourant and a second colourant.

Power is applied to the fixed part. The Eprom informs the programmable logic network. By virtue of the two buttons 201 and 202, the user will choose the value $t_{setpoint}$ corresponding to the length of shading he wishes to make.

He moves the hand piece towards a support formed by a sheet of paper. By pressing the on/off button 209 and by compressing the two reservoirs 225 and 226, the user delivers the products. In doing so, he moves the head along the paper. The current supplied to the electromagnet varies automatically during this movement, thereby modifying the relative proportion of each of the products contained in the two reservoirs in the mixture dispensed, and thus the dyeing or bleaching property of the mixture.

Next, the user places a lock to be treated in this paper, which he closes in order to enclose the lock. He can thus produce a number of locks, or even the entire head. Each time he wishes to lengthen or shorten the length of the lock to be produced, he can redefine $t_{setpoint}$.

Example 2

Use is made of a device as described with reference to FIGS. 29 and 30, which comprises or does not comprise an elastic return member which returns to its initial position after it has been stressed, at a predefined speed, and a system for dispensing a mixture which modifies the proportion of two components depending on the position of an adjusting part moved by the elastic return member.

The user stresses the elastic return member, then, while the latter returns to its initial position, moves an outlet through which the mixture is dispensed in relation to a support which will then be brought into contact with the lock to be treated. Alternatively, he moves the operating handle 168 for the duration of dispensing. In this way, he obtains a deposit of composition, the formulation and the dyeing or bleaching property of which vary longitudinally.

The reservoirs are filled with two bleaching compositions. The first ensures lightening by 2 tones. The second ensures lightening by 4 tones. There are treated 7 locks on the left and 7 on the right.

In order to produce the left-hand locks, a linear shading is applied to aluminium foils (20 cm×5 cm) comprising a small web (20 cm×1.5 cm). Next, the locks are wrapped in the aluminium foils.

In order to produce the left-hand locks, only the second composition is applied to aluminium foils (20 cm×5 cm)

comprising a small web (20 cm×1.5 cm). Next, the locks are wrapped in the aluminium foils.

All of the locks are left for 30 min.

It can be seen that the left-hand part has a much more natural appearance.

Example 3

The same trial as in Example 2 is carried out, except that an asymptotic shading is produced on the left-hand locks.

It can be seen that the left-hand part is much more natural and even more attractive than the left-hand part in Example 2.

Variants, which are not illustrated, of the implementation of the invention can combine characteristics from the various exemplary embodiments that have just been described.

The expression "comprising a" should be understood to be synonymous with "comprising at least one".

The term "between" should be understood as including the limits.

The invention claimed is:

1. A cosmetic device comprising:

a support comprising a water-soluble material; and a composition, carried by the support, for dyeing or bleaching hair, said composition for dyeing or bleaching the hair having a formulation that varies depending on a position of the composition for dyeing or bleaching the hair on the support so as to allow shaded dyeing or bleaching to be produced on the hair by transfer, a dyeing or bleaching property of the composition for dyeing or bleaching the hair varying continuously along a dimension of the support and/or oxidizing or reducing power of the composition for dyeing or bleaching the hair varying continuously along a dimension of the support, wherein the support is configured to:

vary colorimetric characteristics along a lock of treated hair when the support is brought into contact with the lock of hair, the varying being based on the variance in the oxidizing and/or reducing power of the composition for dyeing or bleaching the hair along a longitudinal axis of the support, and/or vary a quantity of the composition for dyeing or bleaching the hair deposited linearly along the longitudinal axis of the support such that colorimetric characteristics along a lock of treated hair vary when the support is brought into contact with the lock of hair.

2. The device according to claim 1, the support being in the form of a sheet element.

3. The device according to claim 1, the support comprising a housing in which the composition for dyeing or bleaching the hair is present.

4. The device according to claim 1, the composition for dyeing or bleaching the hair being in a set form on the support.

5. The device according to claim 1, a dyeing or bleaching property of the composition for dyeing or bleaching the hair varying continuously along the dimension of the support, by way of a linear or asymptotic variation.

6. The device according to claim 1, the support being elongate and the reducing or oxidizing power and/or colour of the composition for dyeing or bleaching the hair varying continuously along the longitudinal axis of the support.

7. The device according to claim 1, the support being designed to be closed around a lock to be treated.

8. A cosmetic assembly comprising:

a device according to claim 1, and at least one of:

an applicator, intended to collect all or part of said composition for dyeing or bleaching the hair and then to apply it to the hair, and/or a solvent for dissolving the composition for dyeing or bleaching the hair and thus ensuring its transfer onto the hair.

9. The cosmetic assembly according to claim 8, the applicator being a roller.

10. A cosmetic assembly comprising:

a plurality of devices according to claim 1, which are designed for different lengths of locks and/or for producing different shadings.

11. A method for dyeing or bleaching the hair, comprising the steps of:

bringing at least one lock of hair into contact with the composition for dyeing or bleaching the hair that comes from a device according to claim 1 in order to obtain shaded dyeing or bleaching of the hair.

12. The method according to claim 11, the composition for dyeing or bleaching the hair being brought directly into contact with the at least one lock of hair.

13. The method according to claim 12, said method comprising, after the composition for dyeing or bleaching the hair has been brought into contact with the at least one lock of hair, a step of bringing the support into contact with water or aqueous hydrogen peroxide solution in order to dissolve all or part of said support and to obtain the shaded dyeing or bleaching.

14. The method according to claim 11, wherein the composition for dyeing or bleaching the hair is brought into contact with a solvent configured to dissolve the composition for dyeing or bleaching the hair, the composition for dyeing or bleaching the hair being applied by transfer along the at least one lock of to the hair by contact with the solvent.

15. The method according to claim 14, the solvent being water or an aqueous hydrogen peroxide solution.

16. The method according to claim 11, comprising, after the composition for dyeing or bleaching the hair has been brought into contact with the at least one lock of hair, the step of closing the support around the at least one lock of hair.

17. The method according to claim 11, further comprising the steps of:

collecting all or part of the composition for dyeing or bleaching the hair with an aid of an applicator before said composition for dyeing or bleaching the hair has been brought into contact with the at least one lock of hair, and bringing the composition for dyeing or bleaching the hair collected by the applicator into contact with the at least one lock of hair in order to obtain the shaded dyeing or bleaching of the hair.

18. A method for preparing a device according to claim 1, comprising the steps of:

arranging the support, and depositing a precursor composition that has a shaded hair dyeing or bleaching power which can vary under an effect of a chemical and energy stimulus on said support, with an aid of an inkjet printer, an airbrush, or a hand-operated mixing device, and subjecting a quantity of the precursor composition to said stimulus in order to develop a dyeing or bleaching property depending on the position on the support, so as to form the composition for dyeing or bleaching the hair.

19. The method according to claim 18, the composition for dyeing or bleaching the hair being deposited and the stimulus being applied depending on a length of at least one lock to be treated.

20. A cosmetic device comprising:

a support comprising a water-soluble material; and a composition, carried by the support, for dyeing or bleaching hair, said composition for dyeing or bleaching the hair having a formulation that varies depending on a position on the support, so as to allow shaded dyeing or bleaching to be produced on the hair by transfer, the variation in the formulation of the composition for dyeing or bleaching the hair making it possible to obtain shaded dyeing or bleaching along a lock of treated hair in a length direction of the lock, comprising first and second regions that have between each other a colour difference in the Commission Internationale de l'Eclairage Lab (CIELab) colour space of greater than or equal to 1, wherein the support is configured to:

vary colorimetric characteristics along a lock of treated hair when the support is brought into contact with the lock of hair, the varying being based on the variance in oxidizing and/or reducing power of the composition for dyeing or bleaching the hair along a longitudinal axis of the support, and/or vary a quantity of the composition for dyeing or bleaching the hair deposited linearly along the longitudinal axis of the support such that colorimetric characteristics along a lock of treated hair vary when the support is brought into contact with the lock of hair.

21. A cosmetic device comprising:

a support comprising a water-soluble material, and a composition, carried by the support, for dyeing or bleaching hair, said composition for dyeing or bleaching the hair having a formulation that varies along a dimension of the support, so as to allow progressive shaded dyeing or bleaching to be produced along a lock of treated hair by transfer, wherein the support is configured to:

vary colorimetric characteristics of a lock of treated hair when the support is brought into contact with the lock of treated hair, the varying based on a variance in the reducing power, oxidizing power and/or color of the composition for dyeing or bleaching the hair along a longitudinal axis of the support, and/or vary a quantity of the composition for dyeing or bleaching the hair deposited linearly along a longitudinal axis of the support such that colorimetric characteristics along the lock of treated hair vary when the support is brought into contact with the lock of hair.

* * * * *